US009394083B2

(12) United States Patent
Cote, Sr. et al.

(10) Patent No.: US 9,394,083 B2
(45) Date of Patent: Jul. 19, 2016

(54) CONTAINER AND CONTAINER LID ASSEMBLY WITH A REMOVABLE SEALING GASKET

(71) Applicant: Klean Kanteen, Inc., Chico, CA (US)

(72) Inventors: Andrew L. Cote, Sr., Merrimack, NH (US); James Osgood, Chico, CA (US); Jake P. Ganem, Cape Neddick, ME (US)

(73) Assignee: Klean Kanteen, Inc., Chico, CA (US)

( * ) Notice: Subject to any disclaimer, the term of this patent is extended or adjusted under 35 U.S.C. 154(b) by 13 days.

(21) Appl. No.: 14/298,340

(22) Filed: Jun. 6, 2014

(65) Prior Publication Data

US 2014/0361027 A1 Dec. 11, 2014

Related U.S. Application Data

(60) Provisional application No. 61/832,694, filed on Jun. 7, 2013.

(51) Int. Cl.

| | |
|---|---|
| ***B65D 39/00*** | (2006.01) |
| ***B65D 53/02*** | (2006.01) |
| ***B65D 39/16*** | (2006.01) |

(52) U.S. Cl.

CPC ..... *B65D 39/00* (2013.01); *B65D 39/16* (2013.01); *B65D 53/02* (2013.01); *B65D 2543/00972* (2013.01)

(58) Field of Classification Search

CPC ..... B65D 39/00; B65D 39/16; B65D 53/02; B65D 2543/00972; B65D 2543/00435; B65D 2543/00231; B65D 2543/00564

See application file for complete search history.

(56) References Cited

U.S. PATENT DOCUMENTS

| | | | | |
|---|---|---|---|---|
| 2,234,485 A * | 3/1941 | Conner | ..... | B65D 43/0218 220/803 |
| 4,305,535 A * | 12/1981 | Brundige | ..... | B65D 21/0222 220/780 |
| 4,399,924 A | 8/1983 | Nilsson | | |

(Continued)

FOREIGN PATENT DOCUMENTS

| | | |
|---|---|---|
| JP | H01240475 A | 9/1989 |
| JP | 2005225545 A | 8/2005 |
| JP | 2010052758 A | 3/2010 |

OTHER PUBLICATIONS

ISA Korean Intellectual Property Office, International Search Report and Written Opinion of PCT/US2014/041325, Oct. 1, 2014, WIPO, 9 pages.

*Primary Examiner* — Andrew Perreault

(74) *Attorney, Agent, or Firm* — Alleman Hall McCoy Russell & Tuttle LLP

(57) ABSTRACT

A container lid assembly configured to be used with and seal a container body is provided. The container lid assembly includes a container lid including a plug member extending downwardly and a gasket-retaining portion adjacent to and at least partially surrounding the plug member, where an outer surface of the plug member defines at least part of the gasket-retaining portion. The container lid assembly further includes a sealing gasket retained on the gasket-retaining portion and configured to provide a seal between the outer surface of the plug member and an interior wall of the container body, where the sealing gasket includes a pull tab that (i) extends away from a sealing portion of the sealing gasket; and (ii) extends downward away from the gasket-retaining portion of the container lid.

6 Claims, 7 Drawing Sheets

(56) References Cited

U.S. PATENT DOCUMENTS

| | | | | |
|---|---|---|---|---|
| 5,421,470 | A | 6/1995 | Dudzik | |
| 6,626,314 | B1 | 9/2003 | McHenry et al. | |
| 7,731,047 | B2 | 6/2010 | Ishimitsu | |
| 8,419,021 | B2 * | 4/2013 | Mellander | F16J 15/061 277/567 |
| 8,640,904 | B2 | 2/2014 | Steininger et al. | |
| 2006/0283859 | A1 | 12/2006 | Lu | |
| 2007/0012698 | A1 | 1/2007 | Durdon et al. | |

* cited by examiner

CONTAINER AND CONTAINER LID ASSEMBLY WITH A REMOVABLE SEALING GASKET

CROSS REFERENCE TO RELATED APPLICATION

This application claims the benefit of U.S. Provisional Patent Application Ser. No. 61/832,694, entitled "Lid Assembly for Drinking Vessel", filed Jun. 7, 2013, which is hereby incorporated by reference in its entirety for all purposes.

BACKGROUND

Containers for storing liquids may include seals "fixedly" secured to a lid (i.e., the seal is semi-permanently attached and not intended to be removed or replaced during the life of the container). These seals often are circular and are configured to prevent liquids from leaking out of the container body through the perimeter of the lid assembly. However, fixedly securing the seal to the lid creates a number of problems. The fixed seals may become damaged (e.g., ripped, torn, etc.,) and thereby compromise the sealing functionality of the container. The elasticity of the fixed seals may decrease over time, further impacting the container's sealing capabilities. As a result, the longevity of the container may be reduced when a fixed seal is used. A further potential problem is that the seal can be in an area that absorbs or traps smells, and the fixed engagement of the seal can make it difficult to clean this area. Attempts have been made to provide replaceable seals in containers. However, these seals are often difficult to remove and/or may require specialized or makeshift tools for removal and replacement. Consequently, seal replacement may be inconvenient and difficult in these types of containers.

SUMMARY

In one approach, a container lid assembly configured to be used with and seal a container body is provided. The container lid assembly includes a container lid including a plug member extending downwardly and a gasket-retaining portion adjacent to and at least partially surrounding the plug member, where an outer surface of the plug member defines at least part of the gasket-retaining portion. The container lid assembly further includes a sealing gasket retained on the gasket-retaining portion and configured to provide a seal between the outer surface of the plug member and an interior wall of the container body, where the sealing gasket includes a pull tab that (i) extends away from a sealing portion of the sealing gasket; and (ii) extends downward away from the gasket-retaining portion of the container lid. The pull tab enables a user to easily grasp the sealing gasket for removal of the gasket from the container lid. Consequently, the user may quickly and effortlessly remove the gasket for cleaning, repair, and/or replacement, thereby increasing the longevity of the container lid assembly.

BRIEF DESCRIPTION OF THE DRAWINGS

FIGS. 1-11 are drawn approximately to scale, however other relative dimensions may be used if desired.

DETAILED DESCRIPTION

The present description relates to containers for holding water and other liquids. In more particular respects, the description is related to a sealing gasket and features of the sealing gasket that function to provide easy removal of the gasket from a container lid assembly of a container. One feature of the sealing gasket which enables easy removal and replacement is a pull tab. Specific geometric characteristics of the pull tab, such as an inward angling of the tab, facilitate easy grasping and removal of the sealing gasket from a container lid. Thus, the user may grasp the pull tab with their fingers, allowing for easy, tool-free gasket removal, and therefore easy cleaning, replacement, etc. Moreover, providing a removable sealing gasket enables the longevity of the container to be increased. Should the seal become worn, damaged, etc., it can be easily replaced with a new gasket at modest expensive relative to replacing the whole container.

Figure 1:
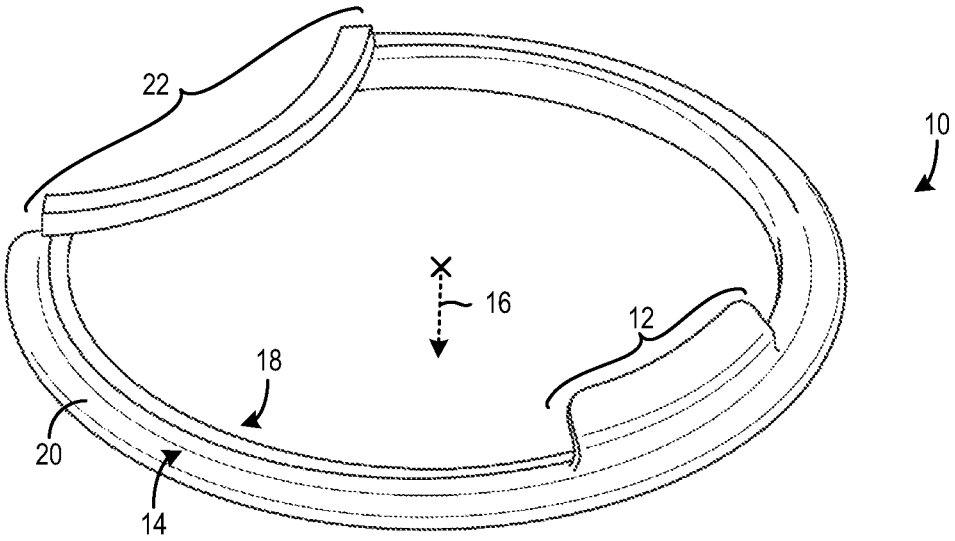
FIG. 1 is a perspective view of a first embodiment of sealing gasket according to the present description.

FIG. 1 depicts a first exemplary embodiment of a sealing gasket 10. The sealing gasket 10 may be constructed out of an elastic material such as silicone, rubber, etc. It will be appreciated that the sealing gasket 10 may be included in a container lid assembly of a container. The container and container lid assembly are discussed in greater detail herein with regard to FIG. 6.

Continuing with FIG. 1, the sealing gasket 10 includes a pull tab 12 that extends away from a sealing portion 14 of the sealing gasket. In this way, the likelihood of the pull tab interfering with the sealing function of the gasket is reduced. Additionally, the pull tab 12 extends downward (the gasket is depicted upside down in the figure). A central vertical axis 16 is provided for reference. It will be appreciated that a downward direction opposes the vertical direction. Additionally, the central vertical axis 16 may be common to the container lid assembly, shown in FIG. 6.

As shown in FIG. 1, the pull tab 12 extends inwardly toward the central vertical axis 16. Additionally, in the illustrated example the sealing gasket 10 includes an interior portion 18 and a sealing extension 20. The sealing extension 20 circumferentially surrounds the interior portion 18. Additionally, the sealing extension 20 is configured to provide sealing engagement with a container body. Specifically, the sealing extension 20 may be resiliently deformed in an upward direction when engaged with the interior wall of a container body to provide a sealing engagement that urges/biases the sealing extension against the interior wall, thereby providing a secure seal "wiper-type" seal, in one example.

The sealing gasket 10 further includes a drinking cutout 22. In the depicted example, the drinking cutout has an arcuate geometry. However, other cutout geometries may be employed as desired. The arcuate portion of the seal may be employed in connection with a similarly-shaped cutout in the lid with which the seal is employed. In some examples, the lid assembly has a rotatable upper member that rotates to selectively cover, to seal and guard against splashing, and uncover the drinking cutout in the lid. In other example embodiments, however, the sealing gasket and its associated lid assembly do not have cutouts.

Figure 2:
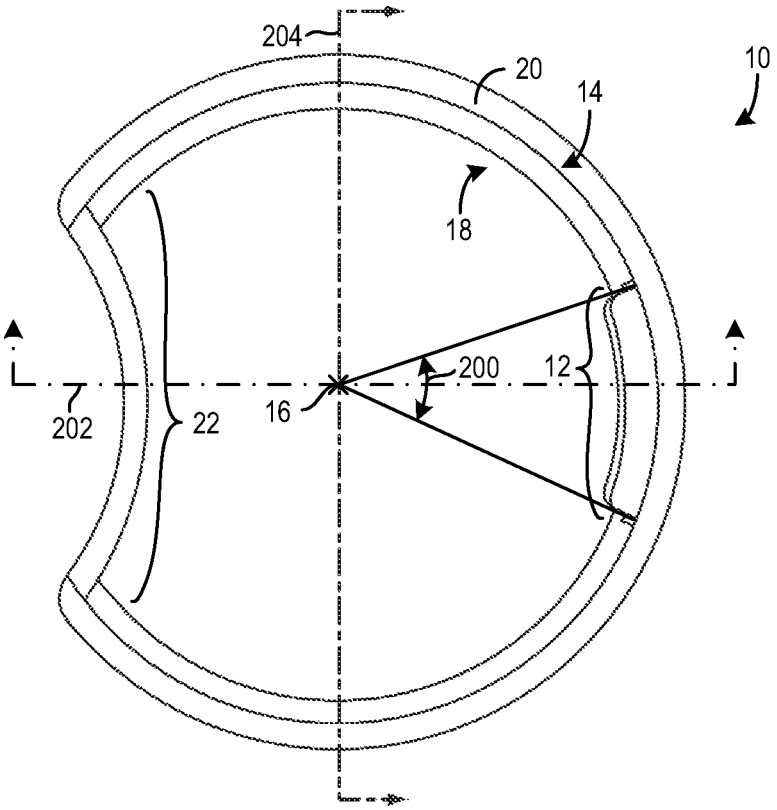
FIG. 2 is a bottom view of the sealing gasket shown in FIG. 1.

FIG. 2 shows a bottom view of the sealing gasket 10 shown in FIG. 1. As depicted in FIG. 2, the pull tab 12 extends around the central vertical axis 16 within an arc range of 0°-43°, indicated at 200. However other arc ranges have been contemplated. In one example, the pull tab 12 may extend around the central vertical axis 16 within an arc range of 0°-50°. Still further in another example, the pull tab may extend around the central vertical axis within an arc range of 0°-30°. Having a pull tab within these arc ranges provides a tab configuration which is easily grasped by a user.

The interior portion 18 and the sealing extension 20 of the sealing gasket 10 as well as the sealing portion 14 are shown in FIG. 2. The drinking cutout 22 is also depicted in FIG. 2. Furthermore, cutting plane 202 shown in FIG. 2 defines the cross-sectional view of the sealing gasket 10 shown in FIG. 3. Likewise, cutting plane 204 shown in FIG. 2 defines the cross-sectional view of the sealing gasket 10 shown in FIG. 5.

Figure 3:
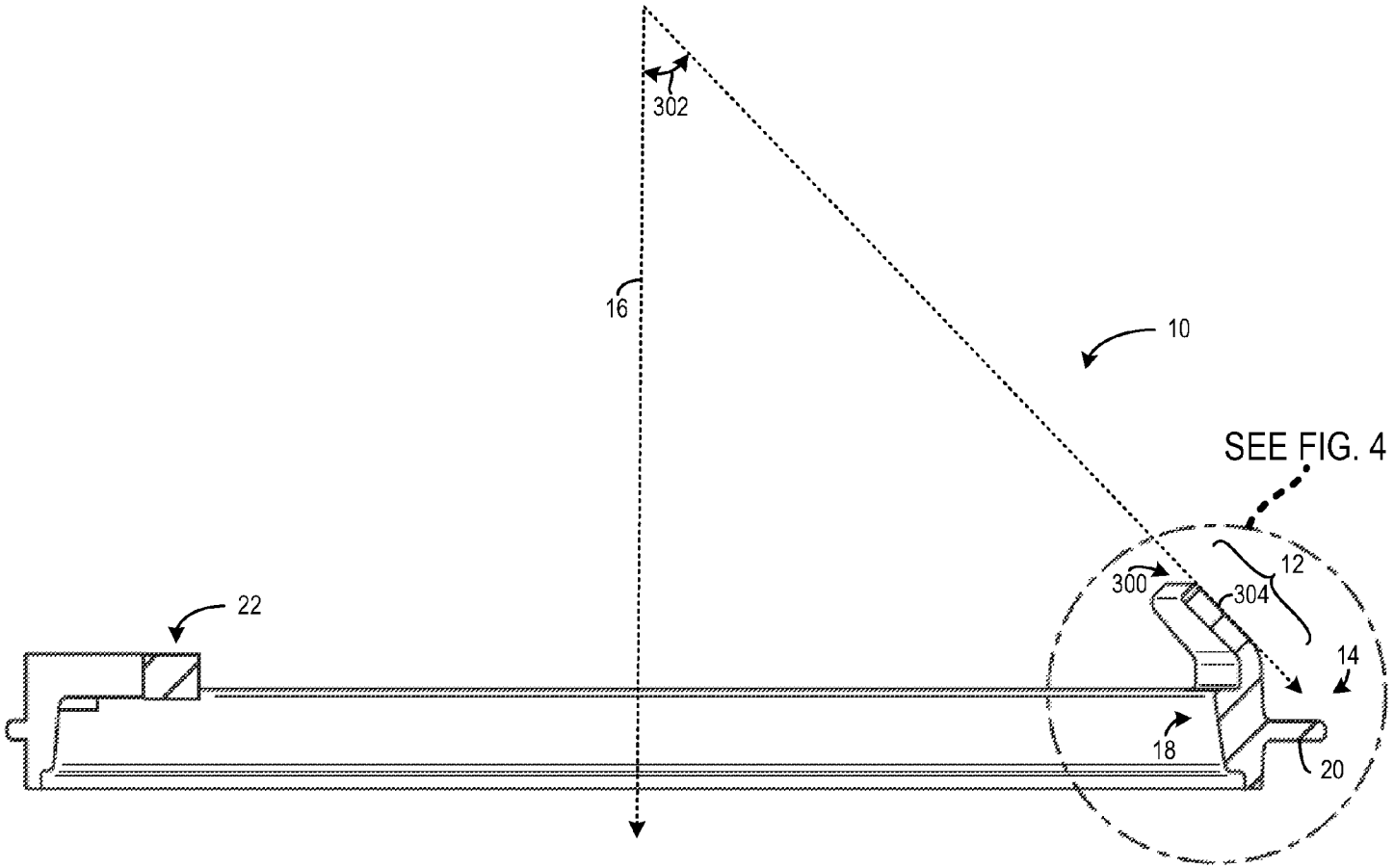
FIG. 3 is a cross-sectional view of the sealing gasket shown in FIG. 1.

FIG. 3 shows a cross-sectional view of the sealing gasket 10. The pull tab 12, sealing portion 14, interior portion 18, sealing extension 20, and drinking cutout 22 are depicted in FIG. 3. As illustrated, the sealing extension 20 extends away from the central vertical axis 16 as well as the interior portion 18. In particular, the sealing extension may be perpendicular to the central vertical axis 16. However, the sealing extension may extend at other angles or take configurations other than shown in the depicted example.

A portion 300 of the pull tab 12 is arranged at an angle 302 relative to the central vertical axis 16. Specifically in the depicted embodiment, the portion includes an exterior planar surface 304. Further, in the embodiment depicted in FIG. 3 the angle is 45°. However in other embodiments, the angle may be between 30°-60° relative to the central vertical axis. It will be appreciated that positioning the pull tab within this angle range enables the user to easily grab the pull tab while at the same time decreases the likelihood of the pull tab interfering with sealing operation of the gasket.

Figure 4:
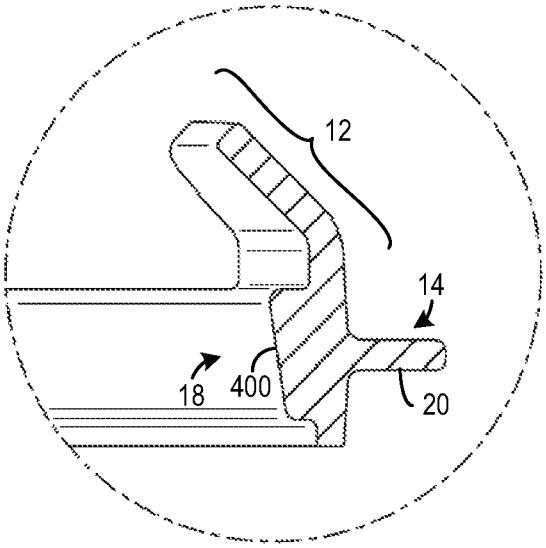
FIG. 4 is an expanded view of a portion of the sealing gasket shown in FIG. 3.

FIG. 4 shows an expanded view of a portion of the sealing gasket 10 shown in FIG. 3. The pull tab 12, sealing portion 14, interior portion 18, sealing extension 20 are all shown. Additionally, the interior portion 18 includes an interior surface 400. It will be appreciated that the interior surface and therefore interior portion may abut an outer surface of a plug member in a lid assembly, discussed in greater detail below with regard to FIG. 6. Additionally, the interior surface 400 is arranged at a non-vertical angle, in the depicted example. Therefore, a portion of the sealing gasket tapers in the vertical direction. However in other examples, the interior surface 400 may be parallel to the central vertical axis 16, shown in FIG. 3.

Figure 5:
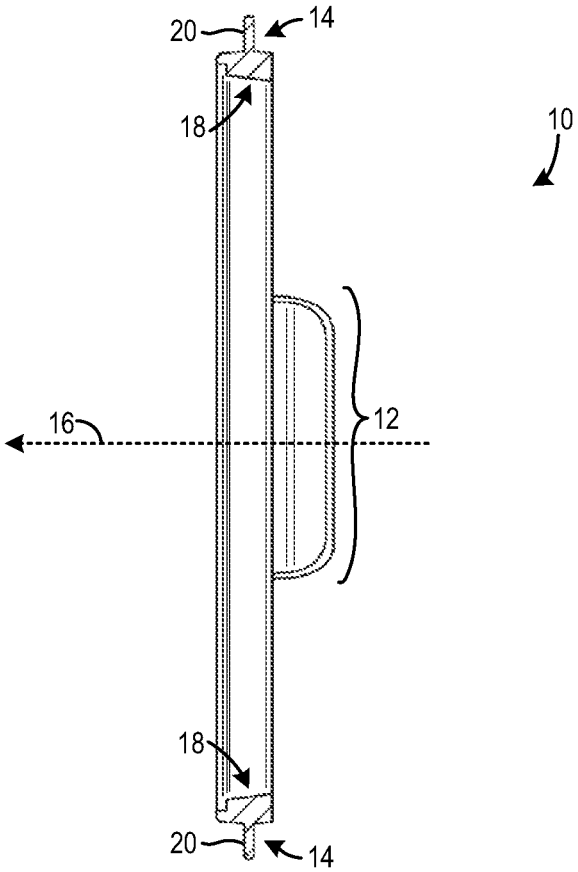
FIG. 5 is another cross-sectional view of the sealing gasket shown in FIG. 1.

FIG. 5 shows a cross-sectional view of the sealing gasket 10 shown in FIG. 2. The pull tab 12, sealing portion 14, interior portion 18, and sealing extension 20 are depicted. The central vertical axis 16 is again provided for reference. As shown, the pull tab extends in a downward direction.

Figure 6:
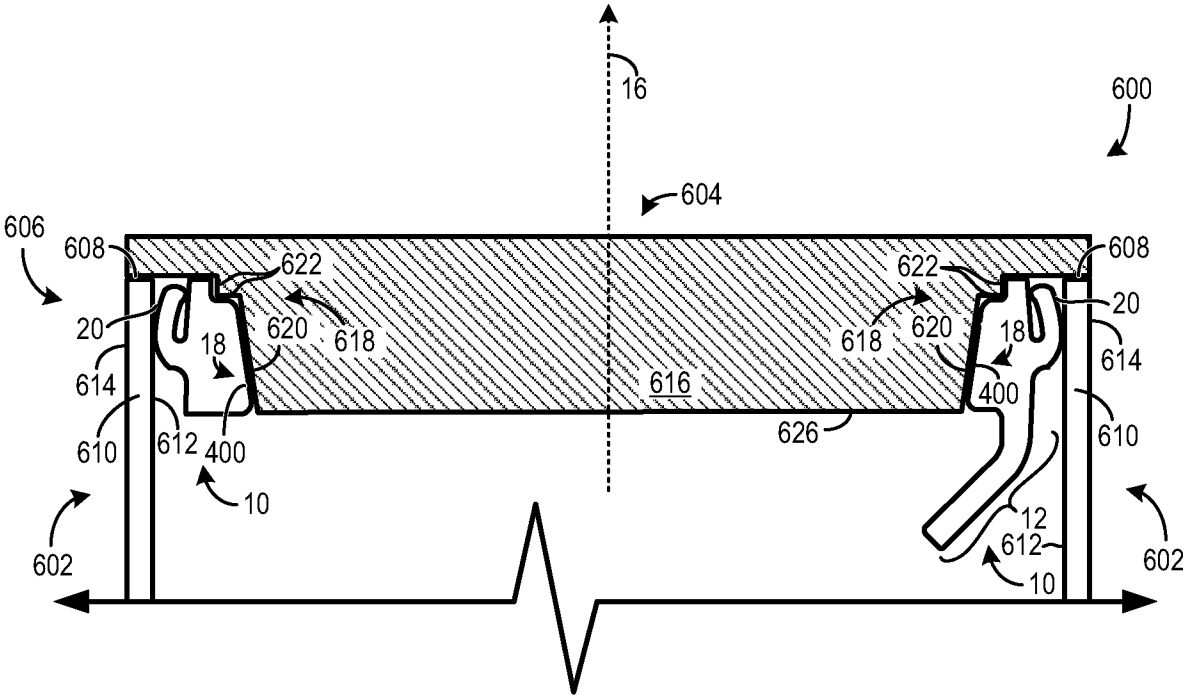
FIG. 6 is a cross-sectional view of the sealing gasket shown in FIG. 1, as engaged with a container lid and a container body.

FIG. 6 shows a cross-sectional view of an exemplary container 600. The container may be any suitable container, such as an insulated stainless steel container. However, containers including polymeric materials and/or uninsulated containers have been contemplated. The sealing gasket and methods described herein are applicable to any type of container where a seal is used to seal against an interior wall of a container body.

The container in FIG. 6 includes a container body 602. In one example, the container body may be generally cylindrical and may narrow toward the top end of the container to accommodate receipt a container lid 604. However, numerous container geometries may be utilized. The sealing gasket 10 is also shown in FIG. 6. It will be appreciated that the sealing gasket 10 and the container lid 604 may form a container lid assembly 606, in one example. It will be appreciated that the container lid assembly is configured to be used with and seal the container body 602.

The container body 602 includes a rim 608. The rim 608 may be included in a neck 610 of the container body 602. In one example, the neck 610 may have a smaller width (e.g., radius) than other portions of the container body 602. However in other examples, the neck 610 may have a similar or greater width than other portions of the container body 602. The container body 602 further includes an interior wall 612 and an exterior wall 614.

The container lid 604 includes a plug member 616 downwardly extending. The central vertical axis 16 is again provided for reference. The container lid 604 further includes a gasket-retaining portion 618 that is adjacent to and at least partially surrounds the plug member 616. Furthermore, an outer surface 620 of the plug member 616 defines at least part of the gasket-retaining portion 618. The gasket-retaining portion 618 may also include surfaces 622.

As shown, the sealing gasket 10 is retained on the gasket-retaining portion 610. Thus, a portion of the sealing gasket 10 may be in face sharing contact with a section of the gasket-retaining portion 610. Specifically in one example, the sealing gasket 10 may be slightly stretched when placed on the gasket-retaining portion 610. In such an example, the sealing gasket 10 is therefore configured to exert a force (e.g., inward force), generated by the elasticity of the gasket, on the gasket-retaining portion 610 to reduce the likelihood of the sealing gasket inadvertently moving around and/or falling off the container lid 604. However, in other examples the sealing gasket may not be stretched when placed on the gasket-retaining portion. In other examples, a bottom portion of plug member may have an outwardly-extending lip that helps retain the gasket in place on the plug member.

The sealing gasket 10 provides sealing between the outer surface 620 and the interior wall 612 of the container body. Specifically, the surface 400 (e.g., interior surface) of the sealing gasket 10 is in face sharing contact with the outer surface 620 of the plug member 616 and a surface of the sealing extension 20 is in face sharing contact with the interior wall 612. In this way, the sealing extension 20 provides sealing engagement with the interior wall 612. As shown, the sealing extension 20 is resiliently-deformed/bent in a vertical direction. Bending the sealing extension 20 in this way enables the sealing extension to exert a "wiper-type" sealing force on the interior wall 612. In this way, the container lid 604 may be secured to the container body 602. However, other sealing configurations of the sealing extension have been contemplated. It will be appreciated that the surface 400 is included in the interior portion 18 of the sealing gasket 10, as previously discussed.

The wiper-type seal engagement discussed in this example can also facilitate retention of the container lid 604 on container body 602. The way that the wiper structure deforms and engages with the interior wall of the container causes the container lid to be retained securely on the container body, such that a significant upward force on the container lid is needed to dislodge the container lid and sealing gasket from sealing engagement with the container body. Typically, this dislodging force is less than the downward force needed to fully engage the container lid 604 and sealing gasket in sealing engagement with the container body 602.

The pull tab 12 is also shown in FIG. 6. In the depicted embodiment, the pull tab 12 extends downward beyond a bottom portion 626 of the plug member 616 and away from the gasket-retaining portion 618. The plug member 616 with the geometric characteristics described above enables a user to quickly and easily remove the sealing gasket 10 from the container lid 604. Specifically, the inward and downward angling of the pull tab as well as the circumferential arrangement of the pull tab assist in this functionality. For instance, a user may grasp the pull tab with their fingers, thereby providing tool-free gasket removal. However, it will be appreciated that tools may be used to aid in gasket removal, if desired. Moreover, arranging the pull tab in an inward and downward direction reduces the likelihood (e.g., substantially inhibits) of the tab interfering with the sealing between the gasket and the container lid and container body.

The container body 602 may be made of any suitable material or combination of materials. In some embodiments, the container body 602 may be constructed out of stainless steel. However, numerous other materials have been contemplated such as bamboo, aluminum, plastic, a combination thereof, etc.

The container lid 604 may also be made of any suitable material or combination of materials. In some embodiments, the container lid 604 is made so that any portions of the container lid (e.g., the internal portion) in contact with liquid are stainless steel. However, in some embodiments other portions of the container lid are made from other materials, such as plastic, bamboo, and/or silicone. Furthermore, the sealing gasket 10 may be made of a different material than the container lid 604. For instance, the sealing gasket may be made of silicone and the container lid may be made of a combination of stainless steel and plastic. Additionally, the container body 602 and the container lid 604 may be manufactured via any suitable process. Such processes may include rolling, stamping, molding, and/or machining, for example.

Figure 7:
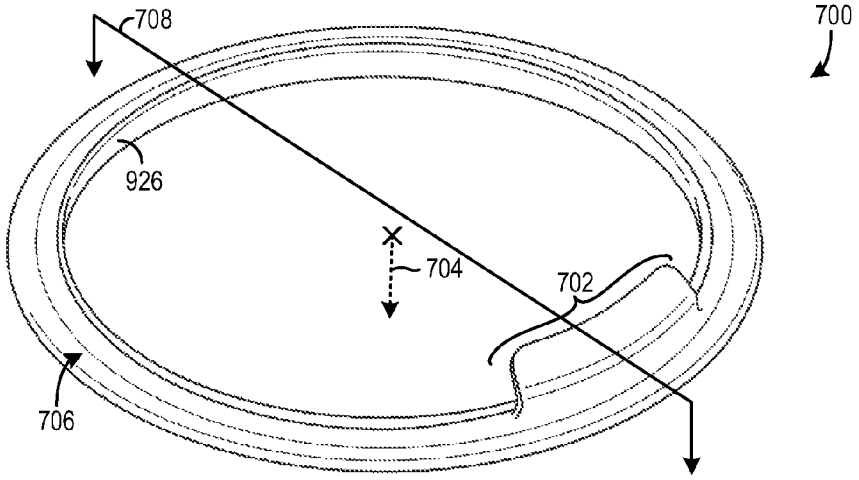
FIG. 7 is a perspective view of a second embodiment of a sealing gasket according to the present description.

FIG. 7 shows a second exemplary embodiment of a sealing gasket 700. The sealing gasket 700 shown in FIG. 7 includes a pull tab 702 having a similar geometry to the pull tab 12 of the sealing gasket 10 shown in FIG. 1. Thus, the geometric characteristics of the pull tab 12, discussed above with regard to FIGS. 1-6, may be common to the pull tab 702. Therefore, the pull tab 702 extends inwardly towards a central vertical axis 704. Additionally, the pull tab 702 may extend around the central vertical axis 704 within an arc range no greater than 0°-50°. Specifically, in the depicted embodiment, the pull tab extends around the central vertical axis 704 within an arc range of 0°-43°. However, other arc ranges have been contemplated.

As shown, the sealing gasket 700 includes a sealing portion 706 which pull tab 702 extends downwardly away from. The sealing portion 706, shown in FIG. 6, has a circular geometry. However, other sealing portion geometries have been contemplated. Cutting plane 708 defines the cross-section of the sealing gasket 700 shown in FIG. 8. The sealing gasket further includes an interior surface 926. In the depicted example, the interior surface 926 has a circular geometry. However other interior surface geometries may be utilized.

Figure 8:
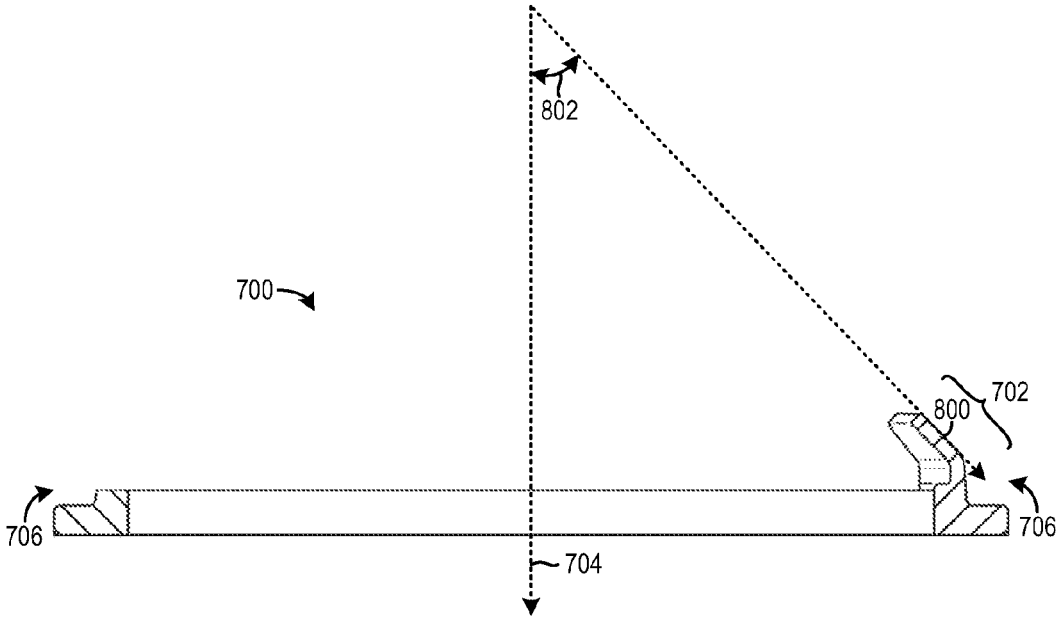
FIG. 8 is a cross-sectional view of the sealing gasket shown in FIG. 7.

FIG. 8 shows a cross-sectional view of the sealing gasket 700 shown in FIG. 7. The pull tab 702 and sealing portion 706 are depicted in FIG. 8. As shown, a portion 800 of the pull tab 702 is arranged at an angle 802 relative to the central vertical axis 704. In the depicted embodiment, the angle 802 is 45°. However, other angles have been contemplated. For instance, the angle 802 may be between 30°-60°.

Figure 9:
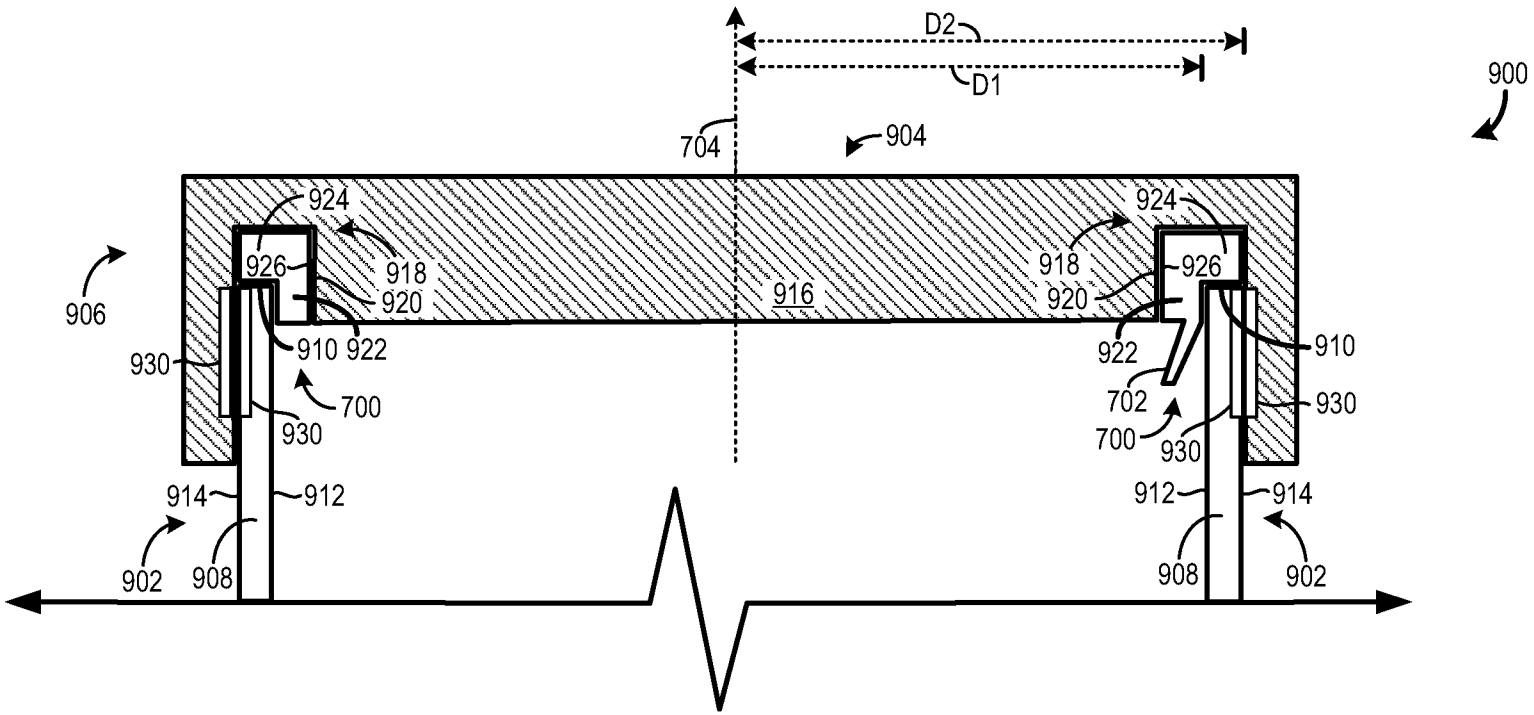
FIG. 9 is a cross-sectional view of the sealing gasket shown in FIG. 7, as engaged with a container lid and container body.

FIG. 9 shows an example container 900 sealed by the sealing gasket 700 of FIGS. 7 and 8. The container 900 includes a container body 902, a container lid 904, and the sealing gasket 700. In one example, the container lid 904 and the sealing gasket 700 may be included in a container lid assembly 906.

The container body 902 includes a neck 908 having a rim 910. The container body 902 further includes an interior wall 912 and an exterior wall 914. Additionally, the container lid 904 includes a plug member 916 extending downwardly and a gasket-retaining portion 918. As shown, the gasket-retaining portion 918 at least partially surrounds the plug member 916. Moreover, an outer surface 920 of the plug member 916 defines at least a part of the gasket-retaining portion 918.

The sealing gasket 700 is retained (e.g., mated with) the gasket-retaining portion 918 and provides a seal between the outer surface 920 of the plug member and the interior wall 912 of the container body. In addition, the rim 910 and a surface of the sealing gasket 700 are in sealing contact. In this way, the likelihood of fluids leaking from the container 900 is substantially reduced. The container body 902 and the container lid 904 include correspondingly threaded portions 930 in the depicted embodiment. However in other embodiments, the threaded portions 930 may be omitted. The threaded portions 930 enable the container lid 904 to be securely attached to the container body 902.

In the embodiment of FIG. 9, the sealing gasket 700 includes a lower portion 922 configured to seal between the outer surface 920 of the plug member 916 and the interior wall 912 of the container body 902. The sealing gasket 700 further includes an upper portion 924 of larger diameter than the lower portion 922. The diameter (e.g., outer diameter) of the upper portion 924 is indicated at D2 and the diameter (e.g., outer diameter) of the lower portion 922 is indicated at D1. As shown D2>D1. The diameters D1 and D2 are measured from the central vertical axis 704 to an outer part of the respective portion of the sealing gasket. Additionally, the upper portion 924 is configured to seal the rim 910 and the lower portion 922 is configured to seal between the outer surface 920 of the plug member 916 and the interior wall 912 of the container body 902.

As shown, the pull tab 702 included in the sealing gasket 700 extends downward away from the lower portion 922, downward away from the gasket-retaining portion 918, and inward toward the central vertical axis 704. Arranging the pull tab in this way enables the pull tab to be easily grasped by a user for removal of the sealing gasket 700. Furthermore, the sealing gasket 700 includes the interior surface 926 that abuts the outer surface 920 of the plug member 916. As shown, the interior surface 926 and the outer surface 920 are vertically aligned. However, other orientations of the surfaces have been contemplated. For instance, the interior surface 926 may be arranged at a 15° angle with regard to the central vertical axis 704 measured in a clockwise direction. In such an example, a portion of the sealing gasket tapers in the vertical direction. Additionally in one example, the sealing gasket 700 may be configured so that a downward force needed to fully engage the container lid 904 and sealing gasket in sealing engagement with the container body 902 is less than an upward force needed to dislodge the container lid and sealing gasket from such sealing engagement.

Figure 10:
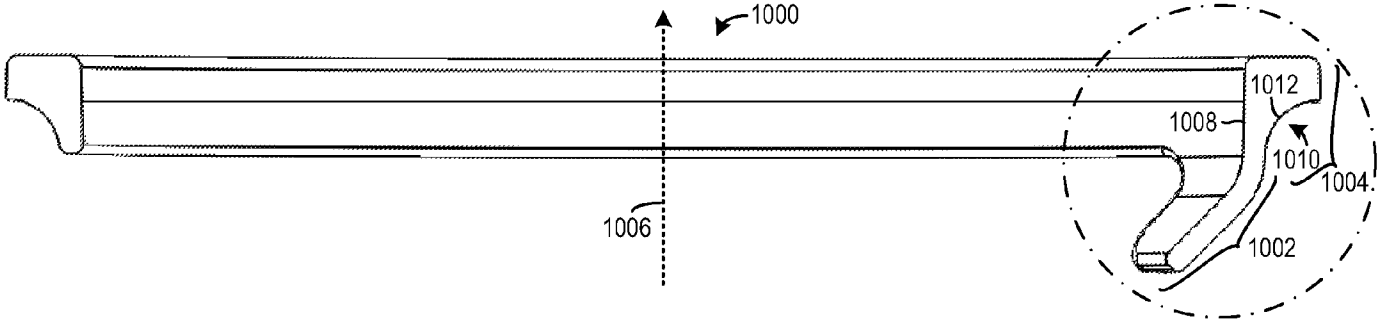
FIG. 10 is a cross-sectional view of a third embodiment of a sealing gasket according to the present description.

FIG. 10 shows a third embodiment of a sealing gasket 1000. It will be appreciated that the sealing gasket 1000 may be constructed out of a resiliently deformable material such as silicone, rubber, etc., as previously discussed. The sealing gasket 1000 includes a pull tab 1002 and a sealing portion 1004. It will be appreciated that the pull tab 1002 may have certain geometric characteristics that are similar to the geometric characteristics of the pull tab 702 shown in FIGS. 7-9. For instance, the pull tab 1002 extends inwardly towards a central vertical axis 1006. Additionally, the pull tab 1002 may extend around the central vertical axis 1006 within an arc range no greater than 0°-50°. Specifically in one example, the pull tab may extend around the central vertical axis 1002 within an arc range of 0°-50°. However, other arc ranges have been contemplated. As shown, the sealing gasket 1000 includes a sealing portion 1004 from which the pull tab 1002 extends downwardly away from. The sealing portion 1004, shown in FIG. 10, has a circular geometry. However, other sealing portion geometries have been contemplated. The sealing gasket further includes an interior surface 1008. In the depicted example, the interior surface 1008 has a circular geometry. However other interior surface geometries may be utilized.

Furthermore, the sealing portion 1004 includes a wedge profile 1010. The wedge profile 1010 includes an exterior surface 1012. In the depicted example, the exterior surface 1012 is concave. Therefore, the exterior surface 1012 may be referred to as a concave exterior surface. However, in other embodiments the exterior surface 1012 may be planar.

Figure 11:
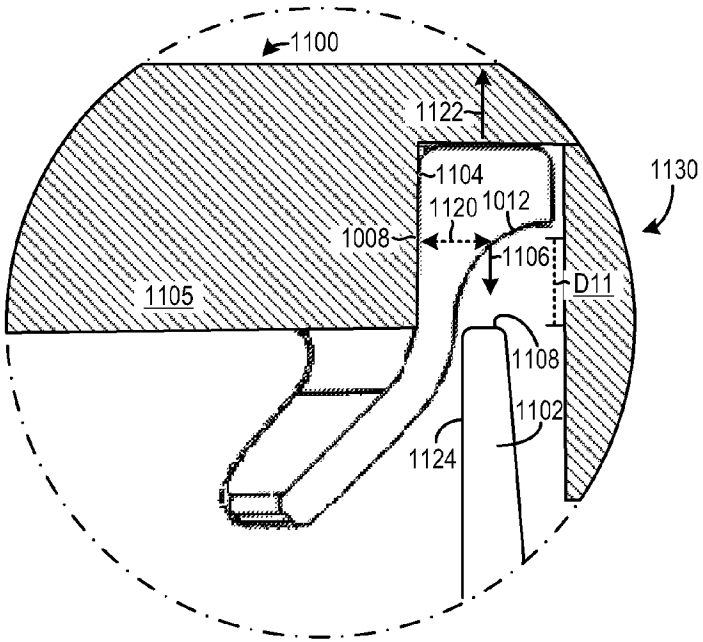
FIG. 11 is an expanded view of the third embodiment of the sealing gasket shown in FIG. 10, as engaged with a container lid and container body.

FIG. 11 shows an expanded view of the sealing gasket 1000 as engaged with a container lid 1100 and container body 1102. The container lid 1100 includes a plug member 1105 having an outer surface 1104 in contact (e.g., face sharing contact) with the interior surface 1008 of the gasket, such that the gasket is retained on the plug member as described in other examples. The container lid 1100 and sealing gasket 1000 may be included as part of a container lid assembly 1130.

FIG. 11 depicts the container lid assembly 1130 moving downwardly relative to container body 1102 (denoted by arrow 1106) into sealing engagement with the container body. The depicted moment of downward motion is just as the interior wall 1124 of the container body is first coming into contact with the exterior surface 1012 the wedge profile 1010. To fully engage sealing between the lid assembly and container body, the lid assembly can be brought further downward by distance D11 (e.g., by rotating the lid assembly as it engages threads on the container body). As described below, the sealing gasket is configured to be resiliently and increasingly compressed as a result of this downward motion, to thereby provide a secure seal.

As shown, the wedge profile 1010 has a thickness 1120 that continuously increases in an upward direction 1122. The wedge profile is configured to cause, as the container lid assembly 1130 is brought downward onto the container body 1102, increasing resilient compression (radial compression) of the sealing portion 1004 of the sealing gasket 1000 between the outer surface 1104 of the plug member 1105 and the interior wall 1124 of the container body 1102. It will also be appreciated that the upper portion of the sealing gasket is compressed between the lip 1108 of the container body and the container lid (axial compression). The shape of the gasket optimally produces these compressive forces to create a more robust seal and minimize the potential for leakage from the container.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing or manufacture strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A container lid assembly configured to be used with and seal a container body, comprising:

a container lid including a plug member extending downwardly and a gasket-retaining portion adjacent to and at least partially surrounding the plug member, where an outer surface of the plug member defines at least part of the gasket-retaining portion; and a sealing gasket retained on the gasket-retaining portion and configured to provide a seal between the outer surface of the plug member and an interior wall of the container body, where the sealing gasket includes a pull tab that (i) extends away from a sealing portion of the sealing gasket; (ii) extends downward away from the gasket-retaining portion of the container lid; (iii) extends downward beyond a bottom portion of the plug member; and (iv) extends inwardly toward a central vertical axis of the container lid assembly, and where a portion of the pull tab is arranged at an angle between 30°-60° relative to the central vertical axis.

2. The container lid assembly of claim 1, where the pull tab extends around the central vertical axis of the container lid assembly within an arc range no greater than 0°-50°.

3. The container lid assembly of claim 1, where the sealing gasket includes an interior portion that abuts the outer surface of the plug member and a sealing extension circumferentially surrounding the interior portion and extending away from the central vertical axis of the container lid assembly, the sealing extension configured to provide sealing engagement with the interior wall of the container body.

4. The container lid assembly of claim 1, where the sealing portion of the sealing gasket has a circular geometry.

5. The container lid assembly of claim 1, where the sealing gasket has a drinking cutout.

6. The container lid assembly of claim 1, where the sealing gasket is configured so that a downward force needed to fully engage the container lid and sealing gasket in sealing engagement with the container body is less than an upward force needed to dislodge the container lid and sealing gasket from such sealing engagement.

* * * * *